US008229704B1

(12) United States Patent
Hammer

(10) Patent No.: US 8,229,704 B1
(45) Date of Patent: Jul. 24, 2012

(54) METHOD FOR MEASURING EFFICIENCY IMPROVEMENT IN A HEATING SYSTEM

(76) Inventor: Jack Hammer, Wantagh, NY (US)

( * ) Notice: Subject to any disclaimer, the term of this patent is extended or adjusted under 35 U.S.C. 154(b) by 938 days.

(21) Appl. No.: 12/050,093

(22) Filed: Mar. 17, 2008

Related U.S. Application Data

(60) Provisional application No. 60/895,080, filed on Mar. 15, 2007.

(51) Int. Cl.
*G06F 11/30* (2006.01)
*G21C 17/00* (2006.01)

(52) U.S. Cl. ..... 702/182; 702/122; 702/183; 702/184

(58) Field of Classification Search ..... 702/121–123, 702/182–190
See application file for complete search history.

(56) References Cited

U.S. PATENT DOCUMENTS 5,971,284 A * 10/1999 Hammer ..... 236/11

* cited by examiner

*Primary Examiner* — Phuong Huynh
(74) *Attorney, Agent, or Firm* — Nolte, Nolte & Hunter; Christopher Garvey

(57) ABSTRACT

A method for measuring efficiency improvement in a heating system. The method includes the following steps: temperature sensors sense an outflow temperature. A controller records the temperature and a call time at a thermostat burner call. Software calculates a percentage of the reduction of fuel consumption, that the efficiency improvement saves. A display displays the percentage saved.

9 Claims, 6 Drawing Sheets

TYPICAL 115/230V POWER & CONTROL -- BOILER BURNER CIRCUIT 4

TYPICAL 115/230V POWER / 24V CONTROL -- BOILER BURNER CIRCUIT 6

METHOD FOR MEASURING EFFICIENCY IMPROVEMENT IN A HEATING SYSTEM

CROSS REFERENCE TO RELATED APPLICATION

This Utility Application takes benefit of U.S. Provisional Patent Application 60/895,080 filed 15 Mar. 2007.

BACKGROUND OF INVENTION

1. Field of Invention

The Present invention relates to an improvement in a method and apparatus for regulating heater cycles to improve fuel efficiency.

2. Related Art

The present inventor has three US Patents on regulating cycles to improve efficiency. These are: U.S. Pat. No. 5,971,284 to Hammer issued Oct. 26, 1999 for an Apparatus For Regulating Heater Cycles To Improve Forced-Air Heating System Efficiency;

U.S. Pat. No. 5,960,639 to Hammer on Oct. 5, 1999 for an Apparatus for regulating compressor cycles to improve air conditioning/refrigeration unit efficiency; and U.S. Pat. No. 5,775,582, issued to Hammer on Jul. 7, 1998 for a Method and apparatus for regulating heater cycles to improve fuel efficiency All the teachings of all these patents are hereby incorporated by reference.

Of these, U.S. Pat. No. 5,775,582, ('582) . . . for regulating heater cycles to improve fuel efficiency is the most relevant, and is the method and device on which the present invention improves. It is a method and apparatus for improving heating system efficiency. An electronic circuit senses a firing signal from a boiler energy value sensor such as a thermostat or pressuretrol. The circuit prevents the boiler energy value sensor from firing the burner, while the circuit senses an energy value of the outflow line at the boiler. The circuit monitors the outflow energy value and records the outflow energy value at a first time of the firing signal. The circuit then continually monitors the outflow energy until it detects an energy drop from the initial outflow energy value. The circuit responds to the energy drop by firing the burner. The invention self adaptively responds to present thermal load, reduces the number of on-off cycles, increases each burner run time while reducing total run time, improves fuel consumption, and reduces air pollution.

Other improvements to the '582 invention have been made prior to this application.

The Hammer device has achieved commercial success as the IntelliCon$^7$-LCH LIGHT COMMERCIAL HYDRONIC HEATING SYSTEM ECONOMIZER.

DESCRIPTION

The disclosures of Hammer U.S. Pat. Nos. 5,775,582 and 5,971,284 and 5,960,639 are hereby incorporated by reference.

The IntelliCon®-LCH 2 FIGS. 1A, 1B is a patented microprocessor-based fuel-saving controller 2 for light-commercial hydronic heating systems 4 and 6. It reduces fuel consumption, wear on boiler parts and burner emissions by actively managing the burner, in conjunction with the boiler operating-control 10, to properly match the boiler output to the required load. This controller indicates actual savings on a burner cycle by cycle basis and also indicates the averages of these cycles. In addition, certain parameters are programmable. All of the programmable parameters and savings values are stored in memory that will not be lost in the event of the unit being turned off or a power failure.

Electric Ratings

Power input: 24,115,220 VAC±10%, 5 Watts max., 50/60 Hz

Control circuit input: 24,115,220 VAC±10%, 0.1 A max. Burden

Relay Contact Form B, 10 A @ 220 VAC (General Purpose)

Environmental Conditions

For Indoor Use

Maximum Altitude (2000M)

Rated Ambient Temperature 32-120° F. (0-49° C.)

Maximum Rh 90% non-condensing

Mains Supply Voltage Fluctuations±10%

Transient Over-Voltage Category (III)

Pollution Degree (2)

Operation

After installation, setting the switch 11 on the controller 2 to the 'ON' position activates the control. The LCD display 12 indicates the various 'modes' of the device, sensed temperatures, and percent savings. The possible messages and their explanation are:

STANDBY MODE

The boiler is operating under its own internal operating-control, which has turned the burner off. This occurs for a period of time after the burner 8 has shut down.

ECONOMIZER MODE

The boiler operating-control 10 has requested the burner 8 to come on but the controller 2 has sensed that there is available heat, which can be used without burning fuel. The burner will remain off and useful heat will be delivered from the boiler's existing supply of residual heat.

HEATING MODE

The controller 2 has released the burner 8 to fire.

HEATING/LO LIM

The controller 2 has released the burner 8 to fire due to a load condition that has caused the water temperature to go below the programmed low limits. This condition may occur occasionally. If this message appears frequently, the boiler operating-control may need to be increased in 5° F. (3° C.) increments until the condition stops or the low limits may need to be adjusted (see Programming section)

During normal operation, one of the above messages will be alternated with the message(s) below.

HEAT TEMP=xxx° F.

The measured value of the boiler outflow water temperature is displayed in ° F. (may be programmed for ° C.).

DOM TEMP=xxx° F.

The measured value of the domestic hot water outflow temperature is displayed in ° F. (may be programmed for ° C.). This message will only appear if the boiler supplies domestic hot water and the optional second sensor is installed (see Sensor Section of these instructions).

I SAVE=xx.x %

The calculated savings of the last burner cycle (I=Instantaneous).

A SAVE=xx.x %

The calculated average savings of all valid burner cycles since commissioning of the controller (A=Average).

Note: This message will display after a minimum of 72 Hours of operation. During this time the power/fault indicator will flicker every second.

ET HRS=xxxxx.x

Total hours of Economizer time. (maximum=65,535.9 hours). The option to display this screen is programmable (Default=ON).

RT HRS=

Total hours of Burner run-time. (maximum=65,535.9 hours). The option to display this screen is programmable (Default=ON).

Installation

The controller 2 is electrically installed in series with the boiler operating-control 10 as shown in the wiring diagrams FIGS. 1A, 1B. It is very important that it 2 be installed, electrically, before any interlocks to ensure proper operation of the burner 8 and to eliminate any alarm or fault conditions that could be caused by the IntelliCon controller 2. AT NO TIME SHOULD ANY SAFETY CONTROLS OR CIRCUITS BE CIRCUMVENTED. Check and determine the voltages of the burner control circuit 10 and power circuit prior to installation.

To ensure maximum savings, it is recommended that the Operating-control be set to a minimum of 170° F. If the setting is found to be higher than 170° F. it should NOT be adjusted.

If a "circulator low-limit" or "B" type aquastat is used, the circulator low-limit should be set 5° F. (3° C.) below the HLOLIM setting. This value can be seen during power-up and is programmable.

Positioning

The unit 2 may be mounted on the equipment either vertically or horizontally. For readability of the display 12, the vertical position is preferred. The unit 2 should be mounted directly on the existing electric enclosure via the unit's standard ½" electrical fitting 14 or surface mounted using the accessory mounting bracket (Not Shown).

Wiring

All wiring and connections must comply with Local and National Electrical Codes. The unit 2 should be wired as shown in the wiring diagrams FIGS. 1A and 1B. It is important to read all of the instructions and the NOTE on the other side of these instructions. Ensure that POWER TO THE UNIT 2 IS OFF DURING INSTALLATION and that all unused leads such as 31-34 are individually taped/insulated with tape 36.

Sensors

Insert the sensor wire 40, plug 41 or 42 FIG. 4 into the 'Heating Water Sensor' connector 43 located on the side of the unit. Mount the sensor on the boiler outflow pipe using tie-wraps 44 (see FIG. 2) or other secure method as close to the boiler as possible. Make sure that the sensor 21 makes good thermal contact with the pipe 50. Cover the sensor with a small piece of pipe insulation 52 (not provided) and secure in place as with tape 55-56 (see FIG. 3).

For boilers which also supply domestic hot water through an internal coil, plug in a second sensor 62 to the 'Domestic Water Sensor' connector 63 and mount the sensor 62 on the domestic hot water outflow-pipe at the storage tank, if present, or at the boiler domestic water coil outlet-pipe, if no storage tank is used. Follow the same procedure to attach the sensor 21 as used above for the 'Heating Water Sensor' 21. This second sensor 62 should not be used if the boiler does not heat the domestic hot water.

In the event that a sensor 21 or 62 fails, the controller automatically goes into bypass mode and returns full control of the burner to the boiler's operating-control 10, the 'Power/Normal' indicator 70 will blink, and the following message will be displayed at the LCD 12 to identify the faulty sensor:

If this message appears check and replace the faulty sensor 21 or 62.

Important—Read Carefully

1. Failure to follow these instructions may result in damage to the system or cause a hazardous condition.
2. Installer must be experienced, qualified, and in certain locations, licensed to work on the system that this control is being installed on.
3. After installation is complete, follow the check-out procedure as provided in these instructions to confirm proper system operation.
4. Intellidyne is not responsible for improper installation or any damages that may result from improper installation.
5. Actual wiring may differ from that shown in the diagrams FIGS. 1A and 1B.
6. Equipment may have controls not shown.
7. Because the IntelliCon can operate with different voltages for the power and control circuits, it has separate common wires 32, 34 for these circuits 4 &6 FIGS. 1A, 1B. It is necessary that these wires are connected to the proper commons or the unit will not function properly. See FIGS. 1A and 1B.

Improper voltage selection may damage the unit and void the warranty.

Checkout

Recheck wiring one last time and make sure that the temperature sensor(s) is plugged into the proper connector(s) 43 or 63. The sensor(s) 21 (62) are only detected during power-up. Set the controller's switch 11 to 'Off/Bypass' and restore power to the boiler. Reset the controller's switch 11 to 'On'. After a brief check of the electronics and displaying various parameters of the controller, the sensor(s) 21 (62) will be detected and the green 'Power/Normal' indicator 70 should light continuously. It is important to verify recognition of the sensors by viewing the temperature reading(s), on the display 12. If the installed sensor(s) 21 (62) are not detected, the IntelliCon controller 2 will not function properly. If the green indicator 70 is blinking or if the display 12 does not verify the installed sensor(s) 21 (62), turn the controller 'Off' 11 and check the sensor 21, 62 installation. After the sensor-check, depending upon the temperature of the boiler water at power-up, the controller 2 will go into one of its various modes. If the controller went into 'STANDBY MODE'; note the operating-control 10 setting and force a burner call by temporarily adjusting the operating-control 10 higher and verifying the change of mode of the controller 2 to the 'ECONOMIZER MODE', 'HEATING MODE' or 'HEATING/LOLIM' mode. If the controller went in to the 'ECONOMIZER MODE' you can either wait for the water temperature to drop and for the controller to go into 'HEATING MODE' or 'HEATING/LOLIM', or by removing a sensor plug 41, the controller 2 will go into bypass mode, and the burner 8 should fire shortly thereafter. If, after adjusting the operating-control 10, the controller 2 went directly into 'HEATING MODE' or 'HEATING/LOLIM' the burner 8 should fire shortly thereafter. The burner 8 should run continuously until the call from the operating-control 10 is satisfied. Once satisfied, the burner should stop firing and the controller 2 should go into the 'STANDBY MODE'. The controller 2 and burner 8 following the above sequence indicates a properly wired and functioning control. Make sure that if the operating-control 10 was previously adjusted, to return it to its' previous setting. If the burner 8 fires for a brief second then stops (even though the operating-control is calling for the burner to run) is likely caused by the Yellow 65 and Red 66 wires being reversed. If the controller does not come out of "STANDBY MODE" when the boiler's operating-control is calling for the burner to run, the unit is wired incorrectly. The likely cause in this situation is either a reversed Yellow 65 and Red 66 wire or an improperly connected 'common' connection 32, 34 for the control circuit 10. See the IMPORTANT note (number 7) above.

Service and Troubleshooting

After Installation and Checkout, the controller 2 does not require maintenance and will provide years of trouble free operation. The unit may be taken out of the circuit at any time by placing the switch 11 to the 'Off/Bypass' position. In this position, the unit 2 has no effect on the system and the burner 8 is controlled as it was prior to the IntelliCon controller's installation. This allows service personnel to troubleshoot or work on the system without the controller 2 intervening.

If at any time the Power/Normal light 70 on the front panel blinks continuously, a sensor is not operating properly and The IntelliCon controller has automatically gone into 'bypass mode'.

If the message "TIMER FAULT" is displayed the switch should be placed into the OFF/Bypass position and service called.

Programming

The following parameters may be changed in the field by following these instructions. Pre-Purge time, Temperature indication in either degrees F. or C, Heating Water Low-Limit, Domestic Water Low-Limit, Maximum Economizer Hold-Off Time, Standby-Timer Override, and whether or not the Economizer Time and/or Burner Run-Time Hour accumulators are Displayed.

The system may also be returned to factory default values and the Average Savings, Economizer Time, and Run-Time accumulators may be cleared.

All of the default values have been carefully selected to result in the greatest savings for the broadest scope of heating system applications. Individual system requirements may require changes. Please note that all of these programmable parameters will affect the amount of savings. Prudent changes are strongly advised.

It is very important that if there is any kind of a delay (more than fifteen (15) seconds), from the time that the Operating-control calls for the burner to start and the burner actually starts, that this time delay value be entered into the controller as a Pre-Purge time (e.g. actual pre-purge timer, Flue Damper interlock, etc.). If there is a delay and the correct value is not programmed into the controller, the savings calculations will be incorrect.

All programming is achieved by inserting and removing a water temperature sensor plug 41 into the dom sensor connector 63, when directed to do so via the display on the controller. The sensor 21 or 62 must be connected to the cable or this will not work!

You have ten (10) seconds to respond to any of the display prompts. The 10 second countdown is displayed on the controller's lcd display 12.

Programming may be stopped or aborted at any time by turning the controller 2 off with switch 11. Any parameters that were changed will remain changed.

Entering Configuration Mode:

To enter configuration mode, the controller must be powered up without any sensors 21, 62 connected. When prompted insert a water sensor plug 41 into the DOM SENSOR connector 63. To confirm, remove the plug 41 when prompted. The unit 2 will then indicated that it has entered "Config Mode". After a 4 second delay the display 12 will advance to the first programmable parameter (RESET DEFAULTS?).

Any changes made to a programmable parameter will be confirmed by indicating "DATA SAVED" before advancing to the next parameter.

RESET DEFAULTS

This parameter will reset all of the programmable parameters to factory defaults. It will not clear any of the accumulators.

RESET SAVINGS

This parameter will clear the Average Savings accumulator.

RESET

This parameter will clear the Economizer Time accumulator.

(Note: this Value is Accumulated Even if not being Displayed.)

RESET RUN-TIME

This parameter will clear the Run-Time accumulator.

(Note: this Value is Accumulated Even if not being Displayed.)

For all of the parameters that follow, after making a change and the "DATA SAVED" message is displayed, you will be given an additional chance to change that parameter again, before advancing to the next programmable parameter.

PREPURGE=xxx SEC

This parameter indicates the pre-purge time currently programmed into the controller 2 (default value=000 seconds). Next you will be prompted to change by inserting the sensor plug 41 within 10 seconds. If not inserted within the 10 seconds the controller 2 will advance to the next programmable parameter (For Degrees F. or C). If inserted you will be prompted to force a burner call, typically done by increasing the set-point of the operating-control 10, and then to remove the sensor plug 41 when the burner 8 starts. When prompted to "FORCE A HEATING CALL" the controller 2 will wait indefinitely (NO 10 second time-out) for the CALL. So it is not necessary to rush.

FOR DEGREES F OR DEGREES C

The controller 2 will prompt you to change to whatever value is NOT currently selected (default value=F). For example, if the parameter is currently set for degrees F., the only choice will be to change to degrees C. This setting will alter the indicated values of the next two (2) programmable parameters, and how the indicated temperatures are displayed when the controller 2 is in operation.

HLOLIM=xxx HLOLIM=xxx° C.

This parameter is used by the controller 2 to set the low-limit temperature for the heating water. When the heating water temperature goes below this setting, the controller 2 will no longer attempt to achieve any savings and will return control to the operating-control. To change this setting, plug in the sensor when prompted. The indicated value will be what is currently set in the controller (default=145° F./62° C.). Next the controller 2 will count up until the maximum settable value is reached (160° F./71° C.), and then will jump to the minimum settable value (90° F./32° C.). Remove the sensor when the desired value is reached. If the 'Heating' water temperature goes below this value while the operating-control is calling for the burner to run, the controller 2 will indicate "HEATING/LOLIM" on the display 12.

DLOLIM=xxx° C. DLOLIM=xxx° F.

This parameter is used by the controller 2 to set the low-limit temperature for the domestic hot water. When the domestic water temperature goes below this setting, the controller 2 will no longer attempt to achieve any savings and will return control to the operating-control 10. To change this setting, plug in the sensor when prompted. The indicated value will be what is currently set in the controller (default=115° F./46° C.). Next the controller 2 will count up until the maximum settable value is reached (150° F./66° C.), and then will jump to the minimum settable value (90° F./32° C.). Remove the sensor when the desired value is reached. If the 'Domestic' water temperature goes below this value while the operating-control is calling for the burner to run, the controller will indicate "HEATING/LOLIM" on the display.

AX ECON=xxx MIN

This feature of the controller is to limit the maximum amount of time that the controller is allowed to remain in the Economizer Mode. To change this setting, plug in the sensor when prompted. The indicated value will be what is currently set in the controller (default=30 minutes). Next the controller 2 will count up until the maximum settable value is reached (120 minutes), then "DISABLED", and then will jump to the minimum settable value (10 minutes). Remove the sensor when the desired value is reached. If the controller goes in to the "HEATING MODE" as a result of this feature, there will be a period (".") appended to the word "MODE" on the display.

ECON TIMER ON? ECON TIMER OFF?

This parameter controls whether or not the Economizer Time accumulator is displayed. The controller 2 will prompt you to change to whatever value is NOT currently selected (default value=ON). For example, if the parameter is currently set for "ON", the only choice will be to change to "OFF". Note—the accumulator is active even if not displayed.

RUN TIME ON? RUN TIME OFF?

This parameter controls 2 whether or not the Burner Run-Time accumulator is displayed. The controller will prompt you to change to whatever value is NOT currently selected (default value=ON). For example, if the parameter is currently set for "ON", the only choice will be to change to "OFF". Note—the accumulator is active even if not displayed.

MAX STBY=xxx MIN

This feature of the controller is to limit the maximum amount of time that the controller is allowed to remain in the Standby Mode. To change this setting, plug in the sensor when prompted. The indicated value will be what is currently set in the controller (default=60 minutes). Next the controller will count up until the maximum settable value is reached (180 minutes), then "DISABLED", and then will jump to the minimum settable value (45 minutes). Remove the sensor when the desired value is reached.

After the last parameter is reached there will be a brief delay and the controller will reset. During this time the sensor(s) 21 or 21 and 62 should be reconnected or the controller 2 will attempt to go into the configuration mode again. If you don't react quickly enough, simply turn the controller off with switch 11, connect the sensor(s) and turn the controller 2 back on.

DETAILED DESCRIPTION OF A PRESENTLY PREFERRED EMBODIMENT

Figure 1A:
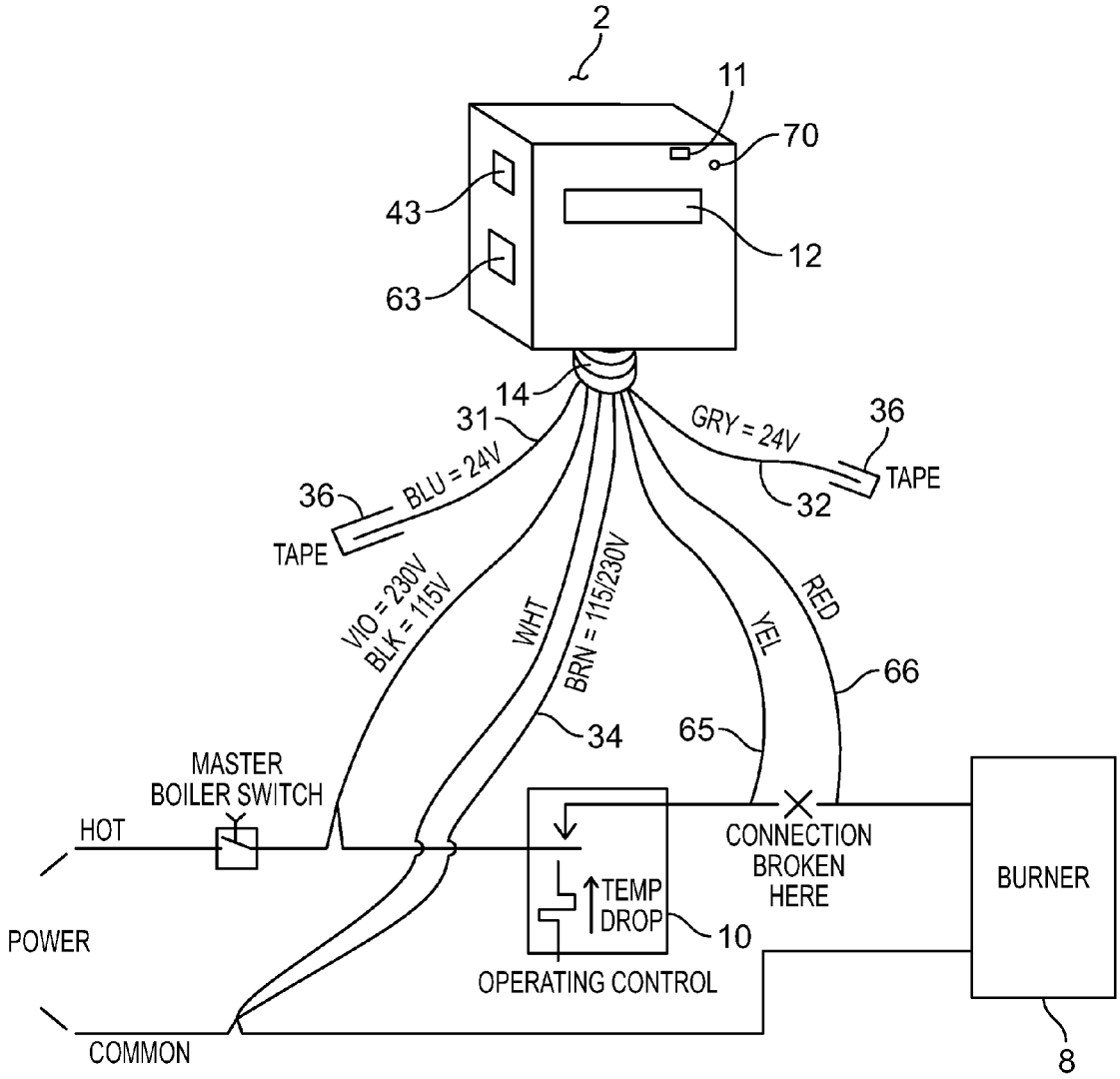
FIG. 1*a* is a wiring diagram of the existing Hammer LIGHT COMMERCIAL HYDRONIC HEATING SYSTEM ECONOMIZER for 120/208 VAC control.
Figure 1B:
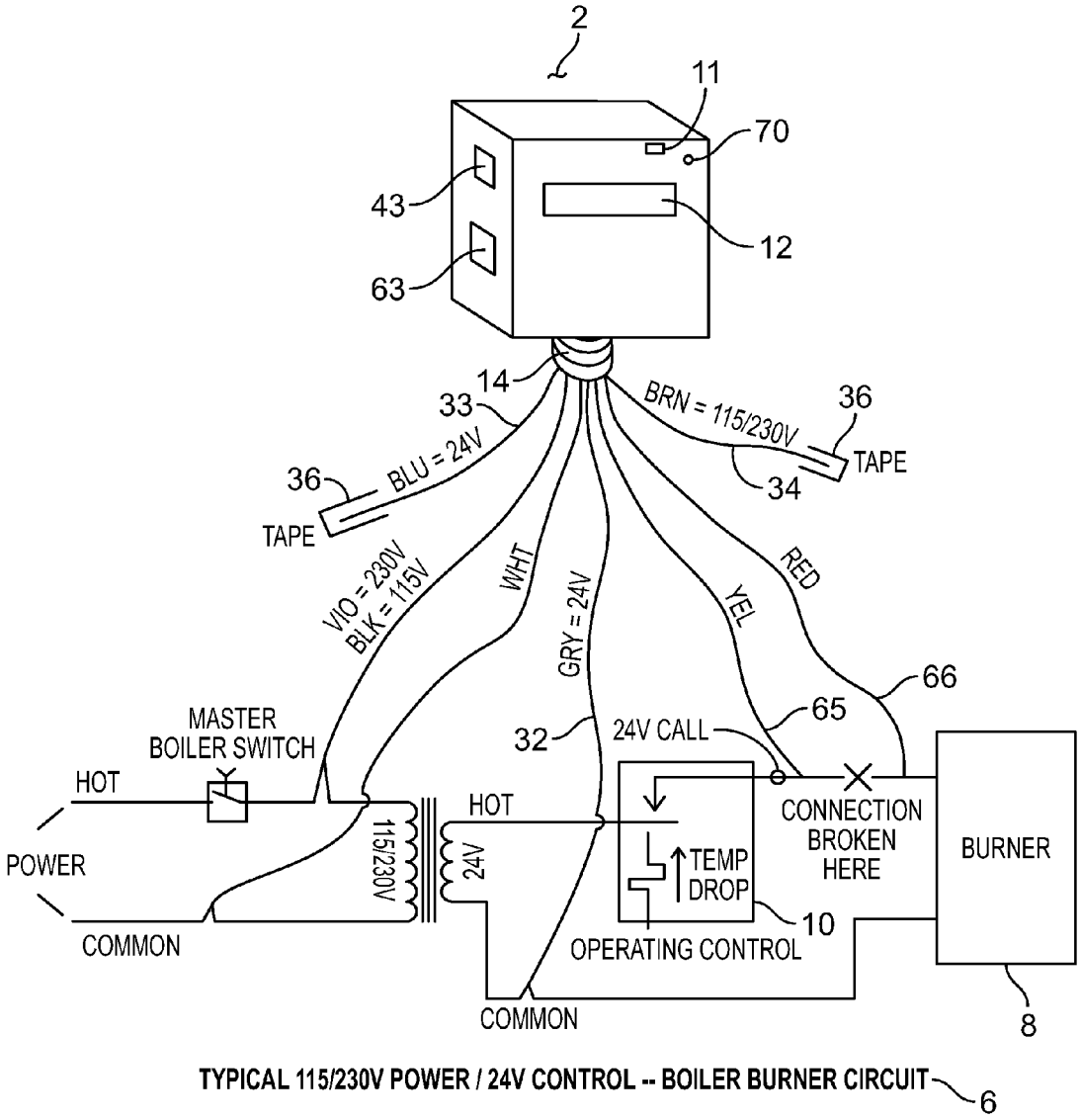
FIG. 1*b* is a wiring diagram of the existing Hammer LIGHT COMMERCIAL HYDRONIC HEATING SYSTEM ECONOMIZER for 24 VAC control.
Figure 2:
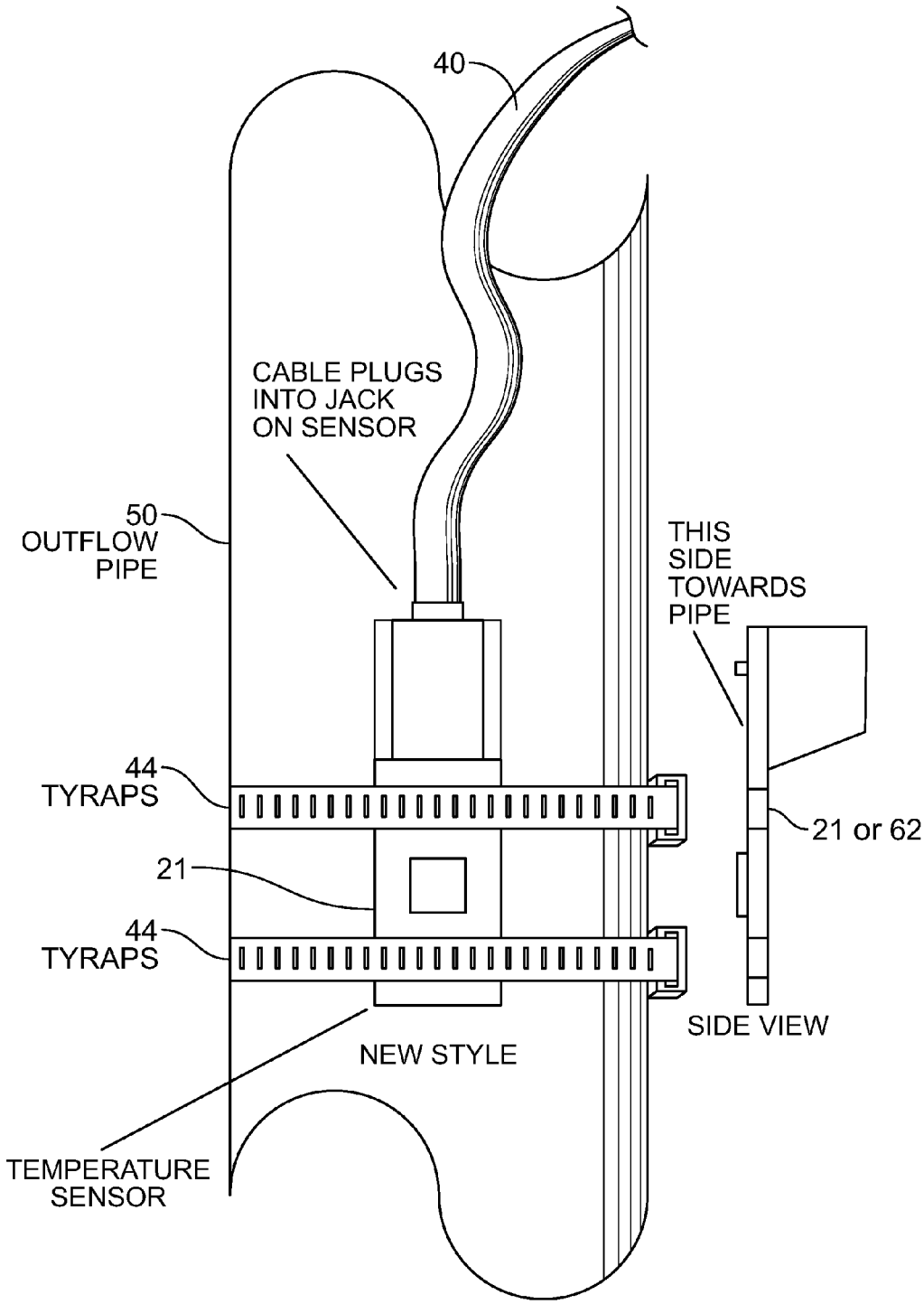
FIG. 2 is a side elevation of a temperature sensor installed for use communicating with an existing Hammer LIGHT COMMERCIAL HYDRONIC HEATING SYSTEM ECONOMIZER.
Figure 3:
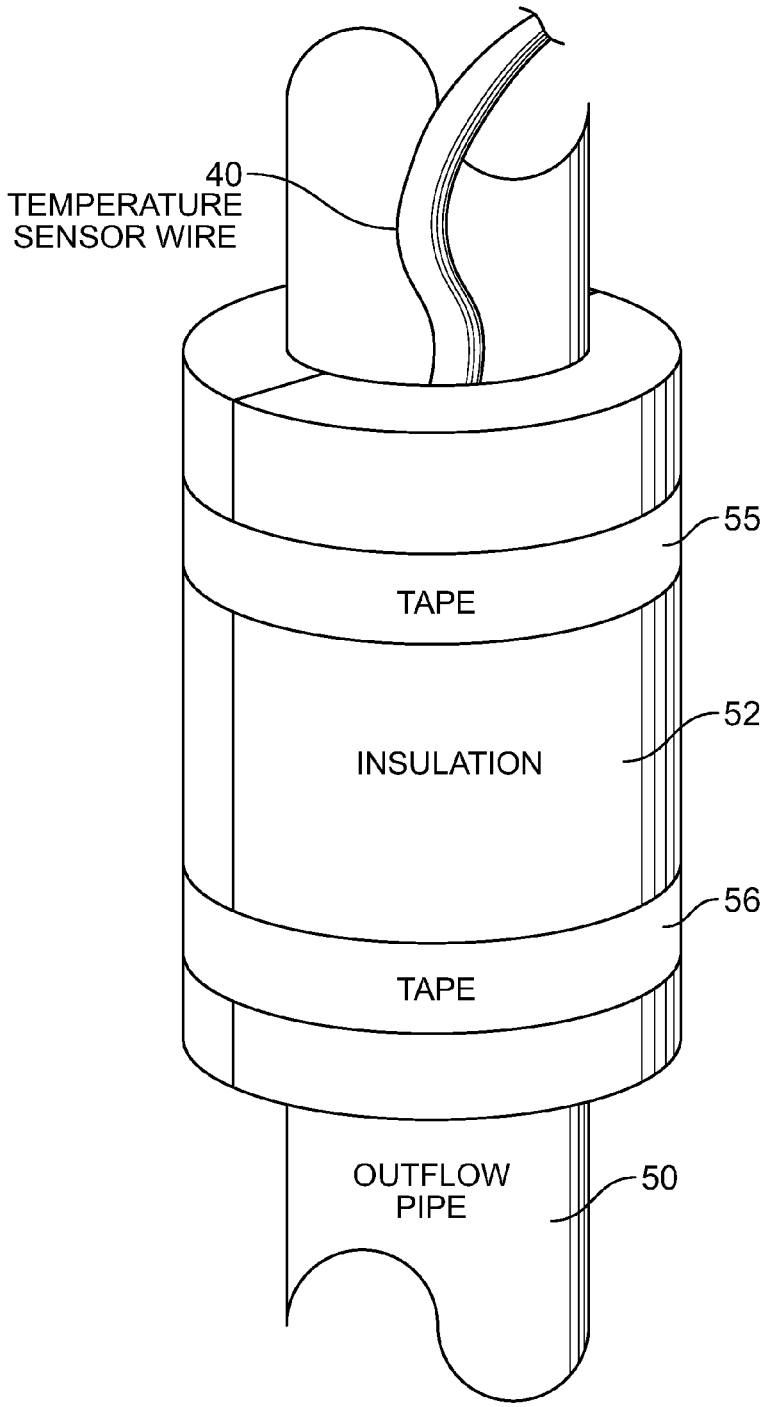
FIG. 3 is a perspective view of said temperature sensor wrapped with insulation.
Figure 4:
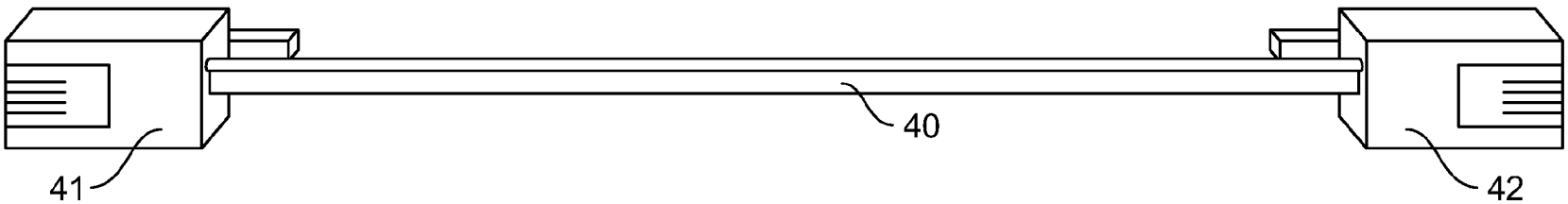
FIG. 4 is a perspective view of standard modular telephone wire, for communication between the sensor 21 and the control unit 2.

The present invention:

Senses outflow temperature using the sensors 21 and or 62 of FIGS. 2-3.

Records temperature and time at a thermostat burner call.

Uses software to calculate the following relationships.

Calculates % of the reduction of fuel consumption that the installation saves.

Displays the % saved on the readout.

Figure 5:
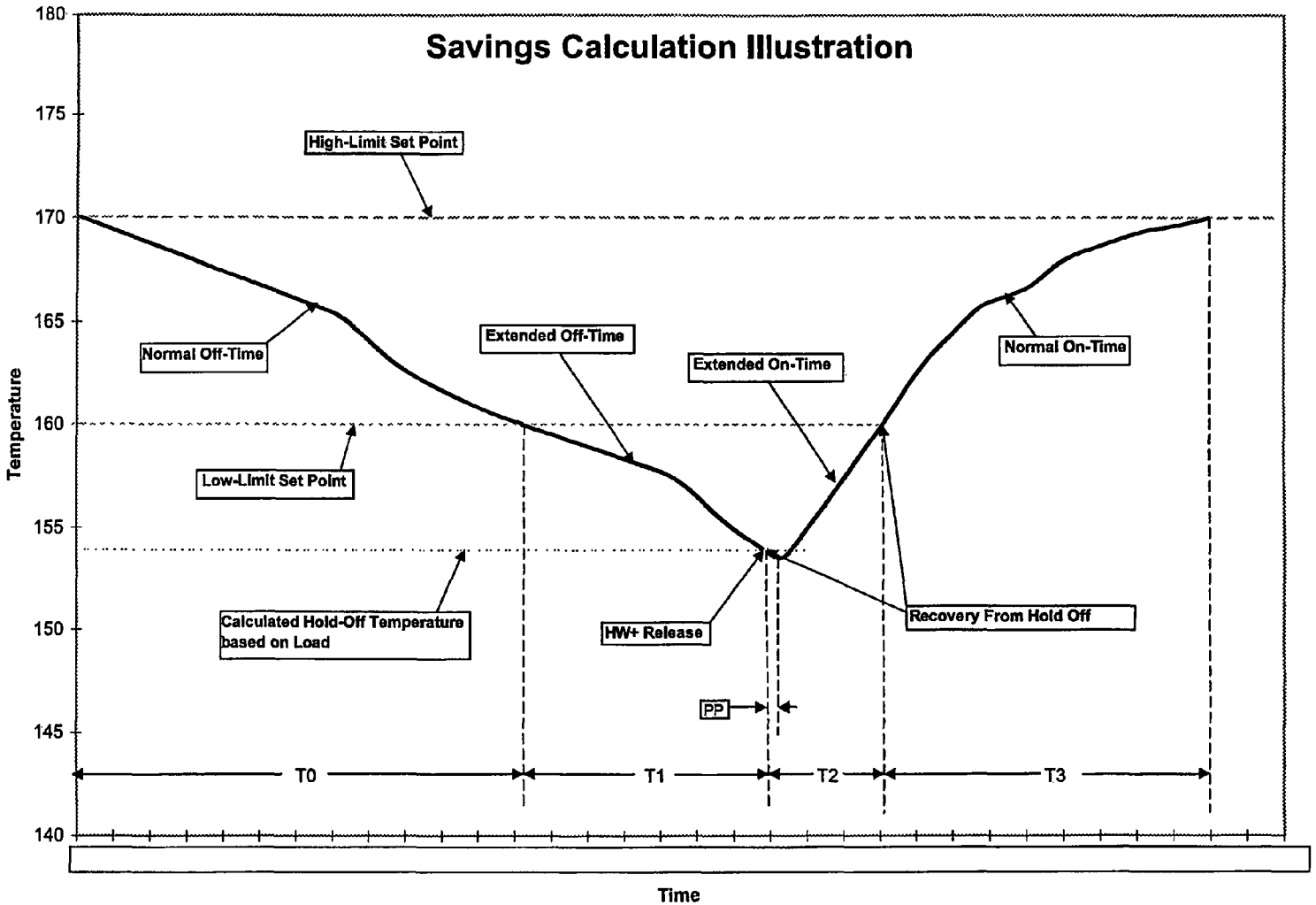
FIGS. 5 is a graph of temperature on the y axis, and time on the x axis.

As shown in FIG. 5, The software calculates:

% Savings=(RTn−RTx)/Rtn where Run Time Normal sans control is RTn where Run Time Extended by the control is RTx The presently preferred savings calculation is comprised of the following formula:

$$\%\ \text{Savings}=(RTn-RTx)/RTn$$

Where: RTn=(K/(T0+T3))*(T3)

RTx=(K/(T0+T1+T2+T3))*(T2+T3−PP)

RTn=Extrapolated total burner run-time for the pseudo original burner cycle

RTx=Extrapolated total burner run-time for the actual burner cycle

K=constant used to normalize the data+3600

PP=pre-purge time

T0 is time from burner shutdown to Thermostat call,

T1 is Intellicon-induced delay of boiler firing time.

T2 is Time from post delay unit call to the Recorded temperature at a thermostat burner call.

T3 is the period during a burner run from Recorded temperature to burner shut-off.

PP is the Pre-firing Purge time.

and

Where: RTn=(K/(T0+T3))*(T3)

RTx=(K/(T0+T1+T2+T3))*(T2+T3−PP)

% Savings are displayed on the screen 12, as the screen scrolls through various factors such as sensor temperature, burner state, sensor functionality, and any other messages that the inventor may decide to communicate to user, installer, or repairman. This is described above as:

I SAVE=xx.x %

The calculated savings of the last burner cycle (I=Instantaneous).

Average Savings

The above formula calculates savings at the present time, for the present cycle, which might be called Instantaneous Savings ($L_{sav}$), or "I Save" on the readout. Another formula is used to calculate accumulated savings over an extended period of time.

The equation for calculating the Average of the accumulated percentage of Savings is as follows:

$$\text{Average Savings}=((A_{sav}*(C_{total}-1))+I_{sav})/C_{total}$$

where:

$A_{sav}$=Average Savings=Total of all $I_{sav}$ divided by ($C_{total}$−1)

$I_{sav}$=value calculated from % Savings equation $C_{total}$=accumulated number of cycles incremented by 1 at the end of T3 ($C_{total}$=$C_{total}$+1).

Programming By Installer

To enable the installer to set factors such as the Pre-firing Purge time, when the unit is turned on, if the sensors are not plugged in, a display screen on the unit will ask the installer to plug in a sensor to a sensor socket 43 or 63 on the unit.

If the installer plugs in a sensor, the unit asks him to confirm by unplugging same.

Then by plugging and unplugging in response to prompts from the screen, the installer can set local parameters to optimize the installation. This obviates the need for programming switches, that usually won't be used after the initial installation.

Similarly, a repairman can engage a diagnostic routine, by plugging and unplugging in response to prompts from the screen. Such a routine would be similar to the routine described in above regarding the IntelliCon[7]-LCH LIGHT COMMERCIAL HYDRONIC HEATING SYSTEM ECONOMIZER.

T0=Normal Burner Off-time. The time, in seconds, it takes for the water temperature to drop from the point when the burner was turned off by the high-limit control until the low-limit temperature is reached. The temperature reading of the heating water sensor (and the domestic sensor, if equipped) is stored when the low-limit temperature is reached (end of T0)

T1=Extended Burner Off-time. The time, in seconds, it takes for the water temperature to drop from the low-limit to the calculated hold-off temperature (calculated by the IntelliCon control). The IntelliCon control is inhibiting the burner from firing at this point.

T2=Extended On-time. The time, in seconds, it takes for the out-flow water temperature to go from the point when the IntelliCon control released the burner to fire until the temperature value that was stored at the end of T0 is reached.

T3=Normal On-time. The time, in seconds, it takes for the out-flow water temperature to go from the temperature value stored at the end of T0 until the high-limit temperature is reached and the burner stops firing.

PP=Pre-Purge Time. This time, in seconds, is the amount of time it takes from the instant that the IntelliCon control releases the burner to fire—until it actually fires. PP times longer than 15 seconds should be programmed into the controller for accuracy of the calculations.

It is important to note that contained within the entire cycle (equal to T0+T1+T2+T3) is the original cycle. This is extrapolated from the entire cycle and is equal to T0+T3. Mathematically comparing these times to a constant allows an apples-to-apples comparison. The constant is necessary because, for example, a 5% savings of a short (time-wise) cycle is not equal to a 5% savings of a cycle of longer duration. So in essence the constant "K", used below, is a value in seconds that represents a 1 hour period (3600 seconds) of time. By determining the number of cycles that could have occurred in this hour, and the resultant run-time that would occur during that hour, it is possible to determine the difference and thus the Savings. The constant also allows the averages to be added and re-averaged, whereby if the individual averages were not normalized, the adding and re-averaging of the averages would be meaningless.

The calculated savings are understated. We feel quite comfortable understating as opposed to overstating. The start-up portions of the cycle are not applied to the extrapolated original cycle thus the original cycle gets the advantage of a hot heat-exchanger, thermal inertia of the heating media, and lack of any type of a delay from when the burner is released and actually fires.

The invention claimed is:

1. A method for measuring efficiency improvement in a heating system, said method comprising the steps of:

sensing an outflow temperature using a temperature sensor, mounted on a heat outflow of said heating system;

recording said temperature and a call time at a thermostat burner call;

using a processor to calculate the following relationships:

calculating a percentage of a reduction of fuel consumption, that the efficiency improvement saves; and displaying the percentage saved on a readout;

where the calculating is by the following formula:

$$\%\ \text{Savings}=(RTn-RTx)/RTn$$

Where: RTn=(K/(T0+T3))*(T3)

RTx=(K/(T0+T1+T2+T3))*(T2+T3−PP)

RTn=Extrapolated total burner run-time for the pseudo original burner cycle

RTx=Extrapolated total burner run-time for the actual burner cycle

K=constant used to normalize the data+3600

PP=pre-purge time

T0 is time from burner shutdown to Thermostat call,

T1 is Intellicon-induced delay of boiler firing time

T2 is time from post delay unit call to the Recorded temperature at a thermostsat burner call T3 is the period during a burner run from the Recorded temperature to burner shut-off.

2. The method according to claim 1 where the equation for calculating an average (Average Savings) of an accumulated percentage of Savings (% Savings) calculations is as follows:

$$\text{Average Savings}=((A_{sav}*(C_{total}-1))+I_{sav})/C_{total}$$

where:

$A_{sav}$=Average Savings=Total of all $I_{sav}$, divided by ($C_{total}$−1)

$I_{sav}$=value calculated from % Savings equation $C_{total}$=accumulated number of cycles incremented by 1 at the end of T3 ($C_{total}$=$C_{total}$+1).

3. A method for measuring efficiency improvement in a heating system, according to claim 1, where:

the heating system is hydronic.

4. A method for measuring efficiency improvement in a heating system, according to claim 3, wherein the calculating is by the following formula:

$$\%\ \text{Savings}=(RTn-RTx)/RTn$$

Where: RTn=(K/(T0+T3))*(T3)

RTx=(K/(T0+T1+T2+T3))*(T2+T3−PP)

RTn=Extrapolated total burner run-time for the pseudo original burner cycle

RTx=Extrapolated total burner run-time for the actual burner cycle

K=constant used to normalize the data+3600

PP=pre-purge time.

5. A method for measuring efficiency improvement in a heating system, according to claim 4, where a there is an equation for calculating an average (Average Savings) of the accumulated percentage of Savings (% Savings), calculated as follows:

$$\text{Average Savings}=((A_{sav}*(C_{total}-1))+I_{sav})/C_{total}$$

where:

$A_{sav}$=Average Savings=Total of all $I_{sav}$ divided by ($C_{total}$−1)

$I_{sav}$=value calculated from % Savings equation $C_{total}$=accumulated number of cycles incremented by 1 at the end of T3 ($C_{total}$=$C_{total}$+1).

6. A method for measuring efficiency improvement in a heating system, according to claim 1 where:

the heating system is hydronic; and the percentage of a reduction of fuel consumption is an average savings.

7. A method for measuring efficiency improvement in a heating system, according to claim 6, where the calculating of the average (Average Savings) is as follows:

$$\text{Average Savings}=((A_{sav}*(C_{total}-1))+I_{sav})/C_{total}$$

where:

$A_{sav}$=Average Savings=Total of all $I_{sav}$ divided by ($C_{total}$−1)

$I_{sav}$=value calculated from % Savings equation $C_{total}$=accumulated number of cycles incremented by 1 at the end of T3 ($C_{total}$=$C_{total}$+1).

8. The method according claim 3 where there is a further calculation of average savings, and a display of such average savings.

9. A method for measuring efficiency improvement in a heating system, said method comprising the steps of:

sensing an outflow temperature using a temperature sensor, mounted on a heat outflow of said heating system;

recording said temperature and a call time at a thermostat burner call;

using a processor to calculate the following relationships:

calculating a percentage of a reduction of fuel consumption, that the efficiency improvement saves; and displaying the percentage saved on a readout;

where the equation for calculating an average (Average Savings) of an accumulated percentage of Savings (% Savings) calculations is as follows:

$$\text{Average Savings}=((A_{sav}*(C_{total}-1))+I_{sav})/C_{total}$$

where:

$A_{sav}$=Average Savings=Total of all $I_{sav}$ divided by ($C_{total}$−1)

$I_{sav}$=value calculated from % Savings equation $C_{total}$=accumulated number of cycles incremented by 1 at the end of T3 ($C_{total}$=$C_{total}$+1)

T3 is the period during a burner run from the Recorded temperature to burner shut-off.

* * * * *